US010278433B2

(12) United States Patent
Esenwein et al.

(10) Patent No.: US 10,278,433 B2
(45) Date of Patent: May 7, 2019

(54) ITEM OF CLOTHING COMPRISING AN ELECTRICAL LOAD AND A SENSOR

(71) Applicant: Robert Bosch GmbH, Stuttgart (DE)

(72) Inventors: Florian Esenwein, Leinfelden-Echterdingen (DE); Joachim Schadow, Stuttgart (DE); Joern Stock, Wernau (DE); Wolfgang Hirschburger, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 154 days.

(21) Appl. No.: 15/386,558

(22) Filed: Dec. 21, 2016

(65) Prior Publication Data

US 2017/0172221 A1 Jun. 22, 2017

(30) Foreign Application Priority Data

Dec. 21, 2015 (DE) ..... 10 2015 226 247

(51) Int. Cl.

| | |
|---|---|
| ***A41D 1/00*** | (2018.01) |
| ***A41D 13/002*** | (2006.01) |
| ***A41D 13/005*** | (2006.01) |
| ***H01H 47/00*** | (2006.01) |
| ***A41D 13/01*** | (2006.01) |

(52) U.S. Cl.

CPC ..... *A41D 1/002* (2013.01); *A41D 13/005* (2013.01); *A41D 13/0025* (2013.01); *A41D 13/0051* (2013.01); *A41D 13/0053* (2013.01); *A41D 13/01* (2013.01); *H01H 47/00* (2013.01); *A41D 2300/322* (2013.01); *A41D 2300/324* (2013.01); *H01H 2203/0085* (2013.01)

(58) Field of Classification Search

CPC .. A41D 1/002; A41D 13/0025; A41D 13/005; A41D 13/0051; A41D 13/0053; A41D 13/01; A41D 2300/322; A41D 2300/324; H01H 47/00; H01H 2203/0085

See application file for complete search history.

(56) References Cited

U.S. PATENT DOCUMENTS

| | | | | |
|---|---|---|---|---|
| 10,004,283 | B1 * | 6/2018 | Baude | A41D 13/0051 |
| 2002/0005340 | A1 * | 1/2002 | Marmaropoulos | H01H 1/12 200/61.58 R |
| 2006/0229520 | A1 * | 10/2006 | Yamashita | A61B 5/0002 600/503 |
| 2014/0107493 | A1 * | 4/2014 | Yuen | A61B 5/0205 600/473 |

* cited by examiner

*Primary Examiner* — Hal Kaplan
*Assistant Examiner* — Elim Ortiz
(74) *Attorney, Agent, or Firm* — Maginot, Moore & Beck LLP

(57) ABSTRACT

An item of clothing includes an electrical load that consumes more electrical energy in a first operating mode than in a second operating mode, a sensor, and a controller. The sensor is configured to identify whether the item of clothing is being worn. The controller is configured to switch the electrical load to the second operating mode when the item of clothing is not being worn.

11 Claims, 4 Drawing Sheets

ITEM OF CLOTHING COMPRISING AN ELECTRICAL LOAD AND A SENSOR

This application claims priority under 35 U.S.C. § 119 to patent application no. DE 10 2015 226 247.2, filed on Dec. 21, 2015 in Germany, the disclosure of which is incorporated herein by reference in its entirety.

BACKGROUND

Items of clothing are equipped with electrical loads in order to increase the wearer comfort or the fit of the item of clothing. In this case, heating elements, for example, can be provided in a jacket, the said heating elements heating up the jacket and thereby increasing the comfort of the jacket wearer when outside temperatures are low. However, secondly, it is also possible to provide lighting devices on an item of clothing in order to increase the safety of the wearer of the item of clothing. These items of clothing usually have a switch with which the electrical load can be switched on and off. If the wearer forgets to switch off the electrical load when he takes off the item of clothing, current consumption by the electrical load causes a rechargeable battery or a battery from which the load is fed to be emptied.

SUMMARY

An object of the disclosure is to provide an item of clothing in which the energy consumption is reduced when the item of clothing is not being worn.

This object is achieved by the item of clothing, the controller for an item of clothing and the method for operating an item of clothing of the independent patent claims. Advantageous refinements are specified in the dependent patent claims.

An item of clothing comprising an electrical load, which electrical load has a first operating mode and a second operating mode, is under consideration. In this case, the electrical load can be a heating element, an air-conditioning device, a ventilation system, a lighting unit or an acoustic signal transmitter. The two operating modes of the electrical load differ in that the electrical load consumes more electrical energy in its first operating mode than in its second operating mode. Furthermore, the item of clothing has a sensor and a controller. The sensor is designed to identify whether the item of clothing is being worn. The controller is designed to switch the electrical load to the second operating mode when the item of clothing is not being worn. Since the electrical load consumes less energy in its second operating mode than in its first operating mode, it is advantageous to switch the electrical load to this operating mode when the item of clothing is not being worn. This is identified by the sensor and implemented by the controller.

In one embodiment, the electrical load has an apparatus for changing a temperature within the item of clothing, in particular a heating element, a cooling element and/or a fan. The said apparatuses can be designed to change a temperature within the item of clothing and thereby increase the degree of wearer comfort. However, the energy consumption by these apparatuses for changing a temperature within an item of clothing is very high, and therefore it is particularly advantageous to provide items of clothing which are equipped with an apparatus of this kind with a wearing sensor. As a result, the controller of the item of clothing is able to switch the electrical load to an operating mode with a lower level of energy or with no energy consumption when the item of clothing is not being worn.

In one embodiment, the electrical load has an apparatus which converts electrical energy into light. This can serve, for example, to increase the safety of the wearer of the item of clothing when the wearer is made more visible owing to the illumination.

In one embodiment, the electrical load has an acoustic signal transmitter. This can be advantageous, for example, in dark operating sites or operating buildings in which there is a low level of visibility. The wearer of the item of clothing can be located considerably more easily by virtue of the acoustic signal transmitter.

In one embodiment, the sensor is an acceleration sensor which is integrated into the item of clothing and is designed to identify, on the basis of the movements of the item of clothing, whether the item of clothing is being worn. In particular, absolutely no more movement of the item of clothing indicates that the item of clothing is not being worn but rather is hung in a cabinet or placed somewhere else. However, it is likewise possible to identify the typical movement and acceleration patterns when traveling in an automobile, so that the energy consumption by the electrical load can be reduced by means of the controller in this case too.

If an acceleration sensor is used to identify whether the item of clothing is being worn, it is advantageous to fit the sensor in a trunk section of the item of clothing since the movements occur considerably less there than, for example, in the sleeves. In this case, it is particularly advantageous to provide the acceleration sensor at the bottom of a neck region. At this point, it is specifically also possible to also identify other situations and events, such as an industrial accident for example, in addition to the wearing status of the item of clothing. The sensor can be connected to the clothing by means of electrical contact or by means of radio transmission technology. It can also be provided that, when the item of clothing is not being worn, the item of clothing switches to the second operating mode only after a prespecified time or a time which can be set by the user. In this case, the time can be prespecified by the user by way of an input device or else, for example, by way of a connection to a mobile device, for example a smartphone. Said mobile device has to be connected to the item of clothing by means of a cable or radio connection in this case.

In one embodiment, the item of clothing has a closure element. The sensor is integrated into the closure element. The integration of the sensor into the closure element of the item of clothing can provide a simple way of identifying whether the item of clothing is being worn.

In one embodiment, the closure element has a zip closure, a press stud and/or a touch-and-close fastener. In this case, the closure element has two parts as well as a closed and an open state. Electrical contact is established between the two parts of the closure element in the closed state, and no electrical contact is established between the two parts of the closure element in the open state. The sensor is designed to detect this electrical contact. Electrical contacts which allow electric current to flow when the closure element of the item of clothing is closed are a simple method for detecting whether the closure elements of the item of clothing are closed or open. Therefore, a very simple method for the sensor, which is intended to identify that the item of clothing is being worn, can be provided in this way.

In one embodiment, a plurality of electrical contact points are provided within the closure element. The sensor is designed to detect, on the basis of these electrical contacts, the extent to which the item of clothing is closed. The controller is designed to switch over the electrical load between the first and the second operating mode on the basis of the information relating to the extent to which the item of clothing is open. This is particularly advantageous when the electrical load is an apparatus for changing a temperature within the item of clothing. When the wearer of the item of clothing opens the closure elements, this can indicate that he is too hot. A higher degree of wearer comfort can then be achieved by changing the operating mode of the electrical load.

In one embodiment, an acceleration sensor is also provided in addition to the sensors which are integrated into the closure elements, the said acceleration sensor likewise being designed to identify, on the basis of the movements of the item of clothing, whether the item of clothing is being worn. By combining the sensors in the closure elements and the acceleration sensor, the controller can switch over more effectively, or choose more effectively, between the operating modes. The function of saving energy in the item of clothing is further improved by utilizing the advantages both of the acceleration sensor and of the closure sensor.

In one embodiment, the second operating mode is a standby mode. This is useful, for example, when, on account of the fact that the item of clothing is not currently being worn, energy should be saved but, on account of the temperatures, it is not expedient to completely switch off the electrical load. This may be the case, for example, when, at low temperatures, the item of clothing is not being worn but it is foreseeable that the item of clothing will be put on again in the near future. In this case, the heating power can firstly be reduced in order to save energy but, secondly, a preheated item of clothing should be available again in the near future. In this case, it may be expedient to reduce the heating power but not to completely switch off the electrical load.

In one embodiment, the second operating mode is a switch-off operation of the electrical load. This is particularly advantageous when a maximum energy saving is intended to be achieved.

A controller for an item of clothing comprising an electrical load, which electrical load has two operating modes with different levels of energy consumption, is designed to identify, with the aid of a sensor, whether the item of clothing is being worn, and to switch the electrical load to the operating mode with the lower level of energy consumption when the item of clothing is not being worn. This controller is the key component of the item of clothing and allows an item of clothing to be operated, in which item of clothing energy is saved when the item of clothing is not being worn.

A method for operating an item of clothing, which item of clothing has an electrical load which has two operating modes with different levels of energy consumption, a sensor is used to identify whether the item of clothing is being worn. The electrical load is switched to the operating mode with the lower level of energy consumption when the item of clothing is not being worn. This serves to save energy for the times at which the item of clothing is not being worn.

Here, items of clothing can be jackets, helmets, gloves, trousers, shoes, vests, T-shirts, sweaters and/or underwear. Other items of clothing which are not mentioned in this list are also covered by the scope of protection of the disclosure.

BRIEF DESCRIPTION OF THE DRAWINGS

The disclosure will now be described in greater detail with reference to the appended figures which schematically show.

DETAILED DESCRIPTION

Figure 1:
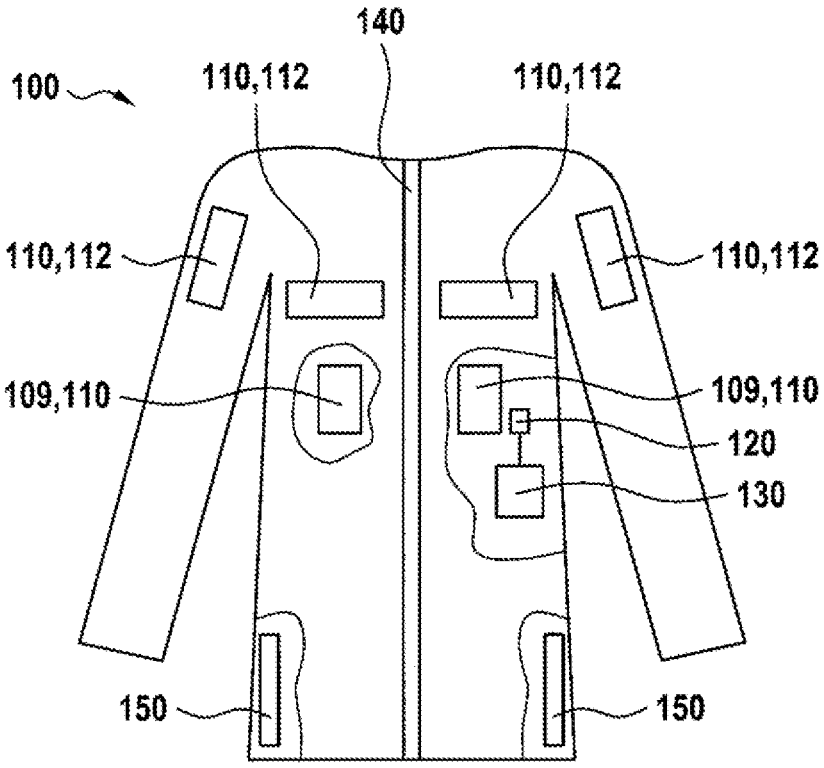
FIG. 1 an item of clothing comprising an electrical load, a sensor and a controller.

FIG. 1 shows an item 100 of clothing, in this case a jacket. However, said item of clothing can also be other items of clothing, for example helmets, gloves, trousers, shoes, vests, T-shirts, sweaters and/or underwear. The item 100 of clothing has at least one electrical load 110. Loads 110 can be designed as apparatuses 109 for changing a temperature within the item of clothing as lighting element 112. Other electrical loads are also feasible. Furthermore, the item 100 of clothing has a first sensor 120, a controller 130, a closure element 140, with which the item 100 of clothing can be closed, and an energy supply unit 150. The closure element 140 can be a zip closure, press studs, a touch-and-close fastener or another possible type of closure element. The energy supply unit 150 can be designed in the form of rechargeable batteries and/or batteries, wherein other possible types of energy supply are also feasible. The first sensor 120 is designed to identify whether the item 100 of clothing is being worn. The controller 130 is designed to switch at least one of the electrical loads 110 to a second operating mode, in which the electrical load 110 consumes less energy than in a first operating mode, when the item of clothing is not being worn. This can be done, for example, by the current consumption by the electrical load 110 being reduced.

In FIG. 1, both apparatuses 109 for changing a temperature and lighting elements 112 are illustrated. It is likewise possible to realize the item 100 of clothing only with apparatuses 109 for changing a temperature or only with lighting elements 112. Similarly, it may be possible to provide another electrical load, which can likewise be switched to and fro between the two operating modes, instead of the two said apparatuses 109, 112.

Figure 2:
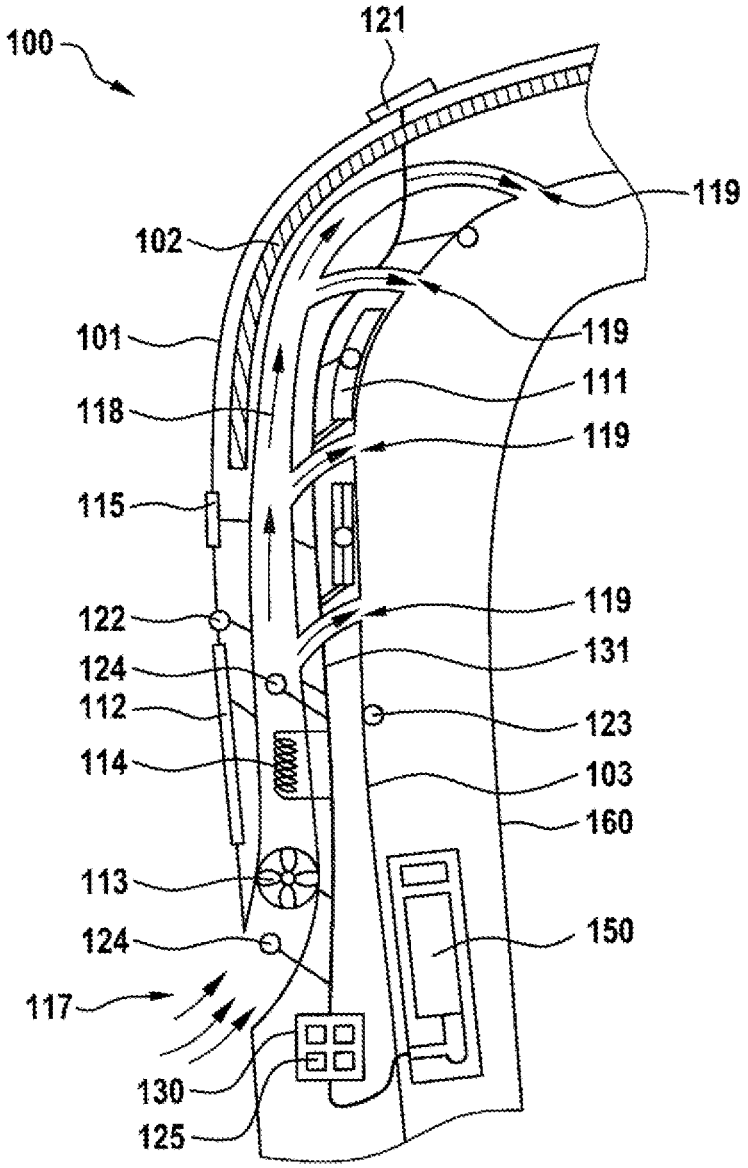
FIG. 2 shows a detailed view of an item of clothing of this kind.

FIG. 2 shows a detail of an item 100 of clothing. This item of clothing has a covering material 101, an insulation 102 and a lining 103. Furthermore, the item of clothing is equipped with a heating element 111, a lighting element 112, a fan 113, a heating coil 114 and an acoustic signal transmitter 115. The heating element 111 is designed to heat the item 100 of clothing. Air can be drawn in at an air inlet 117 by the fan 113. The said air is distributed within the item of clothing by means of the air guide 118 and exits again at the air outlets 119 in the direction of the body 160 of the wearer of the item 100 of clothing. A heating coil 114 with which the air stream can be additionally heated is arranged downstream of the fan 113 in the direction of flow. A wind, rain and light sensor 121 is arranged on the covering material 101 of the item 100 of clothing. An external temperature sensor 122 is likewise arranged on the covering material 101. An internal temperature sensor 123 is arranged on the lining 103. Two flow and temperature sensors 124 are arranged within the air stream of the fan 113, one upstream of the fan and one downstream of the heating coil 114. The said sensors 121, 122, 123, 124 are connected to a controller 130 by a cable 131. Furthermore, the controller 130 has an acceleration sensor 125. An energy supply unit 150 serves to supply electric current to the loads, that is to say to the heating element 111, to the lighting element 112, to the fan 113 and to the heating coil 114.

In one exemplary embodiment, only one apparatus 109 for changing a temperature is provided within the item 100 of clothing. The said apparatus may be, for example, a heating element 111 or a fan 113, but also a cooling element, not illustrated in FIG. 2. The heating coil 114 can, in the widest sense, also be understood to be an apparatus for changing a temperature within an item 100 of clothing.

In one exemplary embodiment, only one lighting element 112 is provided. In one exemplary embodiment, only the acoustic signal transmitter 115 is provided. Any desired combinations of the electrical loads within FIG. 2 are also feasible.

The acceleration sensor 125 determines whether the item 100 of clothing is being worn. Wearing of an item of clothing leads to characteristic movements, and therefore also to characteristic accelerations which can be detected by the acceleration sensor 125. The data from the acceleration sensor 125 is evaluated by the controller 130, and the electrical loads 111, 112, 113, 114, 115 are switched over between different operating modes. In particular, the electrical loads 111, 112, 113, 114, 115 are switched over to an operating mode in which they each have a lower level of energy consumption when the item of clothing is not being worn.

It can be provided that, instead of or in addition to the acceleration sensor 125, the controller 130 is connected to a further sensor which is integrated into a closure element of the item of clothing. This sensor is not illustrated in FIG. 2, but the manner of operation of said sensor will be explained in greater detail below.

Figure 3:
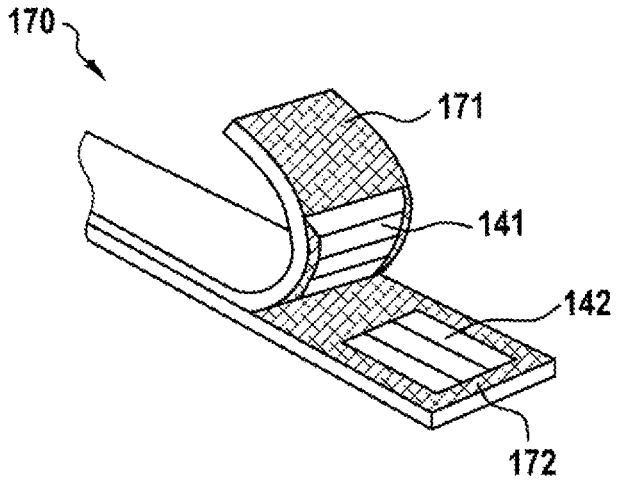
FIGS. 3 to 5 show various options for a closure sensor for an item of clothing of this kind.

FIG. 3 shows a touch-and-close fastener 170 as closure element. In this case, for example, a first touch-and-close fastener strip 171 has hooks and a second touch-and-close fastener strip 172 has loops. A first conductor 141 is fitted on the first touch-and-close fastener strip 171, wherein the first conductor 141 is designed in the form of a rake. A second conductor 142 is fitted on the second touch-and-close fastener strip 172, the said second conductor likewise being designed in the form of a rake but being rotated through 90° in comparison to the first conductor 141. The first conductor 141 and the second conductor 142 can also be situated at a different angle in relation to one another, or can be oriented parallel in relation to one another. As a result, it is possible to ensure that the first conductor 141 establishes electrical contact with the second conductor 142 when the touch-and-close fastener 170 is closed. The controller 130 now evaluates whether the touch-and-close fastener 170 is closed by detecting the contact between the first conductor 141 and the second conductor 142. In this case, the touch-and-close fastener 170 can consist of conventional touch-and-close fastener strips 171 and 172. It is likewise feasible to provide a touch-and-close fastener 170 which is composed of metal instead of the design described in FIG. 3, wherein, in this case, the first conductor 141 is identical to the first touch-and-close fastener strip 171 and the second conductor 142 is identical to the second touch-and-close fastener strip 172.

Figure 4:
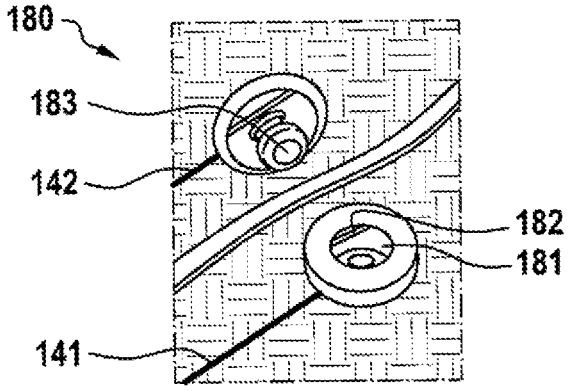

FIG. 4 shows a closure element which is designed in the form of a press stud 180. In this case, a receptacle 181 has a recess into which a stud 183 can be inserted. The recess has a spring element 182 which holds the stud 183 in its position within the recess with a specific force. The receptacle 181 has a first conductor 141, and the stud 183 has a second conductor 142. When the press stud 180 is closed, the first conductor 141 and the second conductor 142 are in electrical contact by means of the components of the press stud 180, that is to say by means of the receptacle 181 and the stud 183, it being possible for the said contact to be detected by the controller 130 of FIG. 1 or 2 once again.

It can be provided that a plurality of the closure elements mentioned in FIG. 3 or 4 are provided. As a result, it is possible to detect the extent to which the item 100 of clothing is open or closed.

Figure 5:
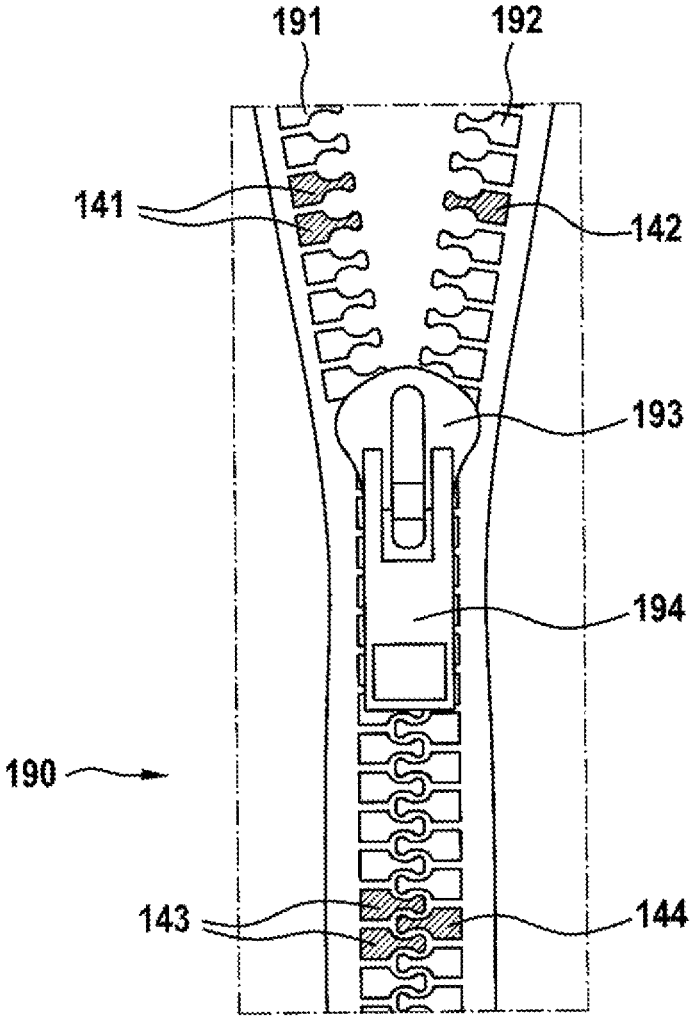

FIG. 5 shows a zip closure 190 as closure element. In this case, the zip closure 190 has a first row 191 of teeth and a second row 192 of teeth, which rows of teeth can interengage with one another by means of a slide 193. The slide 193 has a slide grip 194 by which the slide 193 can be moved in a simple manner. A first conductor 141 and a third conductor 143 are integrated into the first row 191 of teeth. A second conductor 142 is integrated into the second row of teeth such that the first conductor 141 comes into electrical contact with the second conductor 142 when a zip closure 190 is closed. In addition, a fourth electrical conductor 144 is integrated into the second row 192 of teeth, the said fourth electrical conductor coming into electrical contact with the third conductor 143 when a zip closure is closed. In order to make this possible, the teeth of the two rows 191, 192 of teeth outside the four conductors 141, 142, 143, 144 are designed from an electrically non-conductive material. The slide with the slide grip 194 is located between the position of the first and second conductor 141, 142 and, respectively, third and fourth conductor 143, 144. This means that the zip closure is open at the location of the first and second conductor 141, 142, whereas it is closed at the location of the third and fourth conductor 143, 144. Therefore, electrical contact is established between the third conductor 143 and the fourth conductor 144, but not between the first conductor 141 and the second conductor 142. The state, that is to say in particular the extent to which the zip closure 190 is open, can be very readily detected using this information.

In addition to the electrical contacts of the conductors 141, 142 and possibly 143, 144 of FIGS. 3 to 5, it may also be provided that another mechanism is provided, which mechanism allows the controller 130 to detect whether the closure element 140 is closed or open. Optical sensors, electrostatic sensors or magnetic sensors can be used by way of example.

When it is detected in the controller 130 that the item 100 of clothing is closed, on account of it being possible to detect corresponding electrical contact between a first conductor 141 and a second conductor 142, the controller can assume that the item of clothing is being worn. If no electrical contact is detected across the electrical contact points of the closure elements of FIGS. 3 to 5, it can be assumed that the item of clothing is open and therefore is not being worn. In this case, the controller 130 can reduce the energy consumption by the electrical loads.

In one exemplary embodiment, the second operating mode, that is to say the operating mode with the lower level of energy consumption, is a standby mode.

In one exemplary embodiment, the second operating mode is a switch-off operation of the electrical load 110.

The controller 130 is designed to identify, by means of a first sensor 120, whether the item of clothing is being worn. If the item of clothing is being worn, an electrical load of the item 100 of clothing is switched to an operating mode with a lower level of energy consumption.

In an operating method for one of the described items 100 of clothing, a first sensor 120 is used to identify whether the item 100 of clothing is being worn. On the basis of this information, the electrical load 110 of the item 100 of clothing is switched to the operating mode with the lower level of energy consumption when the item 100 of clothing is not being worn.

Although the disclosure has been explained in greater detail by the preferred exemplary embodiments, it is not limited to the said exemplary embodiments exactly. Variations of said exemplary embodiments can be derived by a person skilled in the art, without departing from the scope of protection. This applies particularly for the application of the methods and features of the disclosure to other items of clothing, in particular helmets, gloves, trousers, shoes, vests, T-shirts, sweaters and/or underwear.

What is claimed is:

1. An item of clothing comprising:

an electrical load having a first operating mode and a second operating mode, the electrical load configured to consume more electrical energy in the first operating mode than in the second operating mode;

a sensor configured to identify if the item of clothing is being worn, and if the item of clothing is not being worn; and a controller configured to switch the electrical load to the second operating mode when the sensor identifies that the item of clothing is not being worn, wherein the electrical load includes an apparatus configured to change a temperature within the item of clothing, wherein the item of clothing further comprises a closure element and the sensor is integrated into the closure element, wherein the sensor is configured to detect an extent to which the item of clothing is opened/closed, and wherein the controller is configured to switch the electrical load to one of first and the second operating modes based on information relating to the extent to which the item of clothing is opened/closed.

2. The item of clothing according to claim 1, wherein the apparatus includes at least one of a heating element, a cooling element, and a fan.

3. The item of clothing according to claim 1, wherein the electrical load includes an apparatus configured to convert electrical energy into light.

4. The item of clothing according to claim 1, wherein the electrical load includes an acoustic signal transmitter.

5. The item of clothing according to claim 1, wherein the sensor includes an acceleration sensor integrated into the item of clothing and configured to identify, based on movements of the item of clothing, if the item of clothing is being worn and if the item of clothing is not being worn.

6. The item of clothing according to claim 1, wherein:

a plurality of electrical contact points are included within the closure element, and the sensor is configured to detect, based on a position of the electrical contact points, an extent to which the item of clothing is closed.

7. The item of clothing according to claim 6, further comprising an acceleration sensor integrated into the item of clothing, the acceleration sensor configured to identify, based on movements of the item of clothing, if the item of clothing is being worn and if the item of clothing is not being worn.

8. The item of clothing according to claim 1, wherein the second operating mode is a standby mode.

9. The item of clothing according to claim 1, wherein operation of the electrical load is switched-off in the second operating mode of the electrical load.

10. A controller for an item of clothing including a sensor and an electrical load having two operating modes with different levels of energy consumption by the electrical load, the controller configured to identify, with the aid of the sensor, if the item of clothing is being worn, and if the item of clothing is not being worn, the controller further configured to switch the electrical load to the operating mode with a lower level of energy consumption when the controller identifies that the item of clothing is not being worn, wherein the electrical load includes an apparatus configured to change a temperature within the item of clothing, wherein the item of clothing further comprises a closure element and the sensor is integrated into the closure element, wherein the sensor is configured to detect an extent to which the item of clothing is opened/closed, and wherein the controller is configured to switch the electrical load to one of first and the second operating modes based on information relating to the extent to which the item of clothing is opened/closed.

11. A method for operating an item of clothing including an electrical load having two operating modes with different levels of energy consumption by the electrical load, the method comprising:

using a sensor to identify if the item of clothing is being worn, and if the item of clothing is not being worn; and switching the electrical load to the operating mode with a lower level of energy consumption when the sensor identifies that the item of clothing is not being worn, wherein the electrical load includes an apparatus configured to change a temperature within the item of clothing, wherein the item of clothing further comprises a closure element and the sensor is integrated into the closure element, wherein the sensor is configured to detect an extent to which the item of clothing is opened/closed, and wherein the controller is configured to switch the electrical load to one of first and the second operating modes based on information relating to the extent to which the item of clothing is opened/closed.

* * * * *